United States Patent [19]

Blaese

[11] Patent Number: 4,990,928

[45] Date of Patent: Feb. 5, 1991

[54] PORTABLE ANTENNA FOR MOUNTING ON INSIDE OF MOTOR VEHICLE

[76] Inventor: Herbert R. Blaese, 3314 Olcott Ave., Chicago, Ill. 60634

[21] Appl. No.: 459,939

[22] Filed: Jan. 2, 1990

[51] Int. Cl.[5] ..... H01Q 1/320; H01Q 1/120; H01Q 9/00

[52] U.S. Cl. ..... 343/713; 343/745; 343/878

[58] Field of Search ..... 343/713, 715, 878, 900, 343/888, 892, 745

[56] References Cited

U.S. PATENT DOCUMENTS

| | | | |
|---|---|---|---|
| 3,244,981 | 4/1966 | Der Tatevasian | 343/702 |
| 4,238,799 | 12/1980 | Parfitt | 343/715 |
| 4,692,770 | 9/1987 | Kadokura | 343/713 |
| 4,764,773 | 8/1988 | Larsen et al. | 343/713 |
| 4,794,319 | 12/1988 | Shimazaki | 343/715 |

FOREIGN PATENT DOCUMENTS

| | | | |
|---|---|---|---|
| 1203227 | 7/1959 | France | 343/713 |

*Primary Examiner*—Rolf Hille
*Assistant Examiner*—Peter Toby Brown
*Attorney, Agent, or Firm*—Gerstman & Ellis, Ltd.

[57] ABSTRACT

A portable antenna including a housing, a radiator having its proximal end located within the housing and its distal end located outside of the housing, an electrical cable connected to the housing, and a support member coupled to the housing. The support member extends generally in the opposite direction of the radiator and has a portion for insertion and retention between the side window and door frame of a motor vehicle.

3 Claims, 1 Drawing Sheet

Fig. 1
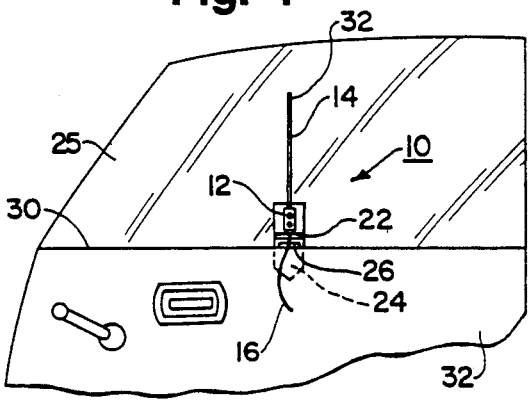
Fig. 2
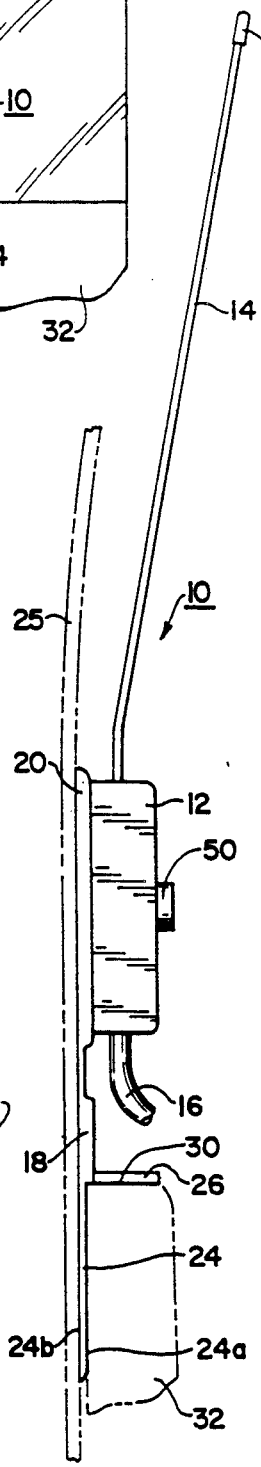
Fig. 3
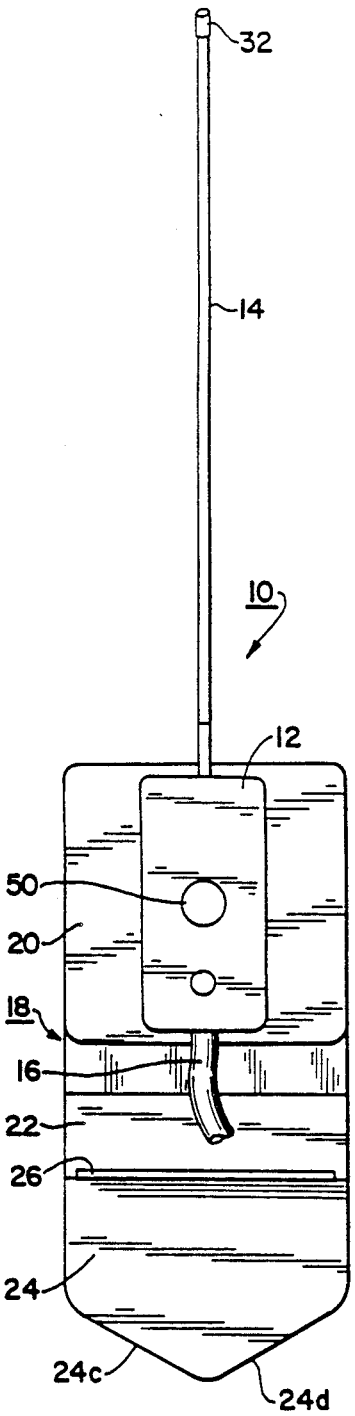
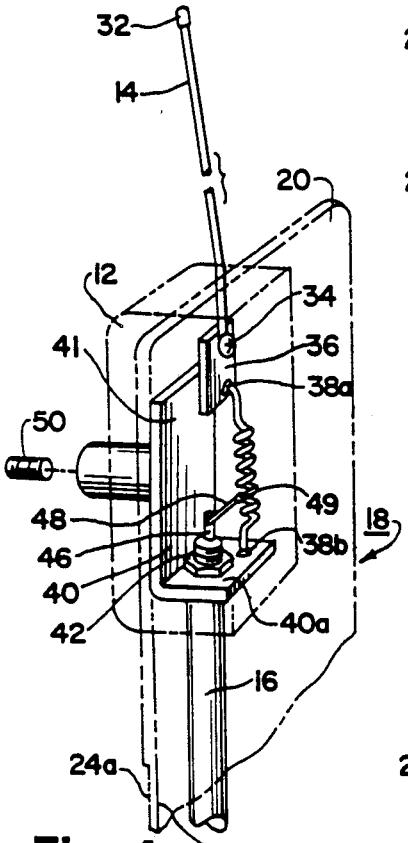
Fig. 4

PORTABLE ANTENNA FOR MOUNTING ON INSIDE OF MOTOR VEHICLE

FIELD OF THE INvENTION

The present invention concerns a novel portable antenna.

BACKGROUND OF THE INVENTION

Mobile antennas, such as cellular antennas, are typically mounted on an exterior surface of a vehicle. While some systems require drilling a hole through a surface of the vehicle for connection of the cable to the antenna, on-glass antennas not requiring the drilling of a hole are in wide use today.

Antennas that are connected to the exterior surface of the vehicle are often damaged or stolen, and some rental car companies do not permit the use of externally mounted antennas. In my co-pending application Ser. No. 440,506 filed Nov. 22, 1989, entitled "Indoor Antenna", I have disclosed a novel antenna that can be mounted on the inside of a vehicle, for example on an inside surface of the vehicle's window, yet which provides effective transmission and reception properties. The antenna disclosed in my application Ser. No. 440,506 can be mounted on any inside surface of the vehicle and is relatively simple in construction, so as not to be unsightly.

I have discovered a portable antenna that is extremely simple to mount within a vehicle and enables the user of the antenna to rapidly insert the antenna in place within the vehicle and retain the antenna in place. When removal is desired, rapid removal can be effected. This enables, for example, drivers using portable or transportable cellular telephones to easily and rapidly attach a highly effective antenna to their telephones. It also enables the user of the antenna to move the antenna from vehicle to vehicle, to carry it with the user, and to in general have an antenna which is easily portable.

Other objects and advantages will become apparent as the description proceeds.

SUMMARY OF THE INVENTION

In accordance with the present invention, a portable antenna is provided which comprises a housing, a radiator having a distal end and a proximal end, with the proximal end being located within the housing and the distal end being located outside of the housing. An electrical cable is coupled to the housing. A support member is also coupled to the housing, with the support member extending generally in the opposite direction of the radiator and having a portion for insertion and retention between the side window and door frame of a motor vehicle. In this manner, the portable antenna can easily be inserted between the side window and door frame of a motor vehicle. Once inserted, the user closes the motor vehicle window if it is not already closed and the antenna is ready for operation once the electrical cable is connected to the telephone. To remove the antenna, it simply needs to be lifted from its location between the side window and door frame of the motor vehicle.

In the illustrative embodiment, the support member has a back and a front with the housing being mounted on the front thereof. The housing is oriented so when the support member is retained between the side window and door frame of a motor vehicle, the radiator will extend generally vertically upward.

In the illustrative embodiment, the support member has a flange extending from its front and across its front. A portion of the flange is oriented so that when the support member is retained between the side window and door frame of the motor vehicle, the flange can be positioned to rest on the window ledge of the door frame.

In the illustrative embodiment, the insertion and retention portion of the support member is generally planar and the planar portion has a lower part that is angled.

A more detailed explanation of the invention is provided in the following description and claims, and is illustrated in the accompanying drawings.

BRIEF DESCRIPTION OF THE DRAWING

FIG. 1 is a front view of a portable antenna constructed in accordance with the principles of the present invention, connected to the door of a motor vehicle;

FIG. 2 is a side elevational view of a portable antenna constructed in accordance with the principles of the present invention;

FIG. 3 is a front view thereof;

FIG. 4 is a perspective view, broken away to show the interior of the housing, of a portable antenna constructed in accordance with the form of the invention.

DETAILED DESCRIPTION OF THE ILLUSTRATIVE EMBODIMENT

Referring to the Figures, an antenna 10 is shown therein comprising a housing 12, an end fed (voltage fed) radiator 14, an electrical cable 16, and a support member 18. Housing 12 is suitably fastened to support member 18 so that it is located at an upper portion 20 thereof. Support member 18 has a central portion 22 and a lower portion 24, with a horizontal flange 26 extending outwardly, as shown most clearly in FIG. 2, from the line which separates the central portion 22 from the lower portion 24.

Lower portion 24 has a planar front **24*a*, a planar back 24*b*, an angled lower edge 24*c* and an oppositely angled lower edge 24*d*. The spade shape of lower portion 24 is such that the user of antenna 10 may insert lower portion 24 between the side window 25 of a vehicle and the door frame of the vehicle. This is illustrated in FIG. 1 wherein antenna 10 is shown so inserted. The insertion can be accomplished with the window in its open position, and once so inserted, the window may be lifted to its closed position. Alternatively, the antenna 10 may be inserted when the window is already in its closed position. The undersurface of flange 26 will rest upon the ledge 30 of the vehicle door 32**.

In a specific example although no limitation is intended, support member 18 has a total height of about 4 inches, a total width of about 2 inches, and lower member 24 has a thickness of 1/16 inch.

Radiator 14 is one-half wavelength in electrical length, or a full multiple thereof, such as one wavelength, one and one-half wave lengths, two wavelengths, etc., with phase cancelling coils between each one-half wave length. Radiator 14 has a distal end 32 and a proximal end 34 (FIG. 4). The proximal end 34 is located within the housing 12 and is connected by suitable means to a radiator plate 36. Radiator plate 36 is an electrically conductive member and is generally rectilinear in configuration. Also connected to radiator plate 36 by suitable connector means is a coiled inductor 38. Thus one end 38*a* of inductor 38 is connected to radiator plate 36 and the other end 38*b* of inductor 38 is connected by suitable connection means to a ground plate 40. The ground plate 40 is a L-shaped member having a surface 41 thereof that is generally parallel to the surface of radiator plate 36. In this manner, ground plate 40 and radiator plate 36 form the electrodes of a capacitor, which cooperates with inductor 38 to form an L-C network.

The base 40*a* of ground plate 40 is fastened to housing 12 by nut 42 which also serves to connect coaxial cable 16 to the housing. Coaxial cable 16 has a central conductor 46 and a conventional spaced concentrically surrounding ground conductor (not shown). The ground conductor of coaxial cable 16 is electrically connected to nut 42 and ground plate 40, while the central conductor 46 is connected via an electrically conductive extension 48 to a tapped location 49 of inductor 38.

In the illustrative embodiment, although no limitation is intended, radiator 14 is a 14.5 inch whip, radiator plate 36 has a width of ⅝ inch and a length of 15/16 inch, inductor 38 has a 11 turns and is tapped 2.5 turns from end 26*b*, and ground plate 40 has a height of 1.75 inches.

A set screw 50 engages ground plate 40. In order to tune the L-C network, set screw 50 is turned to move ground plate 40 toward or away from radiator plate 36. This varies the capacitance of the L-C circuit. The impedance of the antenna is matched at the factory by tapping central conductor 46 of coaxial cable 16 to the appropriate location on inductor 38.

It can be seen that a novel portable antenna has been shown and described, with a support member that is coupled to the housing. The support member extends generally in the opposite direction of the radiator and has a portion for easy insertion and retention between the side window and door frame of the motor vehicle.

Although illustrative embodiment of the invention has been shown and described, it is to be understood that various modifications and substitutions may be made by those skilled in the art without departing from the novel spirit and scope of the present invention.

What is claimed is:

1. A portable antenna for mounting adjacent the lower window ledge of a motor vehicle which comprises:

a housing;

a radiator having a distal end and a proximal end, the proximal end being located within the housing and the distal end being located outside of the housing;

an electrical cable coupled to the housing;

a support member coupled to the housing, the support member extending generally in the opposite direction of the radiator and having a portion for insertion and retention between the side window and the lower window ledge of the door frame of a motor vehicle with the radiator being located on the inside of the vehicle;

said support member having a back and a front with the housing being mounted on the front thereof, the housing being oriented so that when the support member is retained between the side window and the lower window ledge of the door frame of a motor vehicle, the radiator will extend generally vertically upward;

said support member having a flange extending from its front with a portion of the flange being oriented so when the support member is retained between the side window and door frame of a motor vehicle, the flange can be positioned to rest on the window ledge of the door frame.

2. A portable antenna for mounting adjacent the lower window ledge of a motor vehicle which comprises:

a housing;

a radiator having a distal end and a proximal end, the proximal end being located within the housing and the distal end being located outside of the housing;

an electrical cable coupled to the housing;

a support member coupled to the housing, the support member extending generally in the opposite direction of the radiator and having a generally planar portion for insertion and retention between the side window and the lower window ledge of the door frame of a motor vehicle with the radiator being located on the inside of the vehicle;

said support member having a flange extending from its front with a portion of the flange being oriented so that when the support member is retained between the side window and the door frame of a motor vehicle, the flange can be positioned to rest on the window ledge of the door frame.

3. A portable antenna for mounting adjacent the lower window ledge of a motor vehicle which comprises:

a housing;

capacitive means located within the housing;

inductive means located within the housing;

said capacitive means and said inductive means cooperating to form an LC network within the housing;

a radiator having a distal end and a proximal end, the proximal end being located within the housing and the distal end being located outside of the housing;

first electrically conductive means coupling the proximal end to the inductive means;

an electrical cable having a main conductor and a ground conductor;

second electrically conductive means connecting the main conductor to the inductor means at a location on the inductor means that is spaced from the proximal end connection;

means for varying the impedance of the LC network;

a support member coupled to the housing, said support member extending generally in the opposite direction of the radiator and having a portion for insertion and retention between the side window and the lower window ledge of the door frame of a motor vehicle with the radiator being located on the inside of the vehicle;

means connecting said housing to said support member;

the support member having a back and a front with the housing being mounted on the front thereof, the housing being oriented so that when the support member is retained between the side window and the lower window ledge of the door frame of a motor vehicle, the radiator will extend generally vertically upward; and the support member having a flange extending from its front with a portion of the flange being oriented so when the support member is retained between the side window and the lower window ledge of the door frame of a motor vehicle, the flange can be positioned to rest on the window ledge of the door frame.

* * * * *